United States Patent [19]

Berner, Jr. et al.

[11] Patent Number: 4,561,499

[45] Date of Patent: Dec. 31, 1985

[54] TUBING SUSPENSION SYSTEM

[75] Inventors: Paul C. Berner, Jr.; Eugene L. Brickman, both of Houston, Tex.

[73] Assignee: Vetco Offshore, Inc., Ventura, Calif.

[21] Appl. No.: 639,713

[22] Filed: Aug. 13, 1984

[51] Int. Cl.[4] ..... E21B 23/00; E21B 33/043; E21B 43/013

[52] U.S. Cl. ..... 166/85; 166/384; 166/319; 285/140

[58] Field of Search ..... 166/85, 125, 123, 181, 166/208, 212, 216, 217, 348; 285/140–143, 18

[56] References Cited

U.S. PATENT DOCUMENTS

| | | | |
|---|---|---|---|
| 3,693,714 | 9/1972 | Baugh | 166/348 |
| 4,067,062 | 1/1978 | Baugh | 166/85 X |
| 4,416,472 | 11/1983 | Fowler et al. | 285/142 X |
| 4,488,596 | 12/1984 | Akkerman | 166/217 |

*Primary Examiner*—Stephen J. Novosad

*Assistant Examiner*—David J. Bagnell

[57] ABSTRACT

A tubing suspension system for undersea well production operations employs a nonoriented tubing hanger having an inner body for supporting a tubing string and a landing collar for supporting the tubing hanger on a wellhead casing. The tubing hanger includes three cooperating concentric sleeve assemblies which are employed to lock and seal the tubing hanger to the wellhead housing. The outer sleeve assembly includes a locking actuator and a dual seal assembly and is separately retrievable from the remainder of the hanger assembly. A nonorienting hydraulic set running tool is employed to run the tubing hanger, set the seals, lock the tubing hanger to the wellhead casing, retrieve either the outer sleeve assembly or the entire tubing hanger. The running tool includes a hydraulically controlled actuating sleeve which carries a latch dog assembly which locks with the tubing hanger.

27 Claims, 15 Drawing Figures

TUBING SUSPENSION SYSTEM

BACKGROUND OF THE INVENTION

This invention relates to a hanger system which is employed to suspend a tubing string in a well in the ocean floor, a running tool employed with the tubing hanger, and a method preferably associated with the tubing hanger and the running tool. More particularly, this invention relates to a nonorienting hydraulic set tubing hanger and a nonorienting hydraulic set running tool employed for running, landing, locking, sealing, and retrieving the tubing hanger.

In oil well applications, various devices and methods have been advanced for suspending strings of tubing from a tubing hanger which is seated on a subsea casing hanger in a subsea wellhead housing. Various running tools, including hydraulically actuated tools, have been developed for "running" the tubing hanger to the wellhead, locking the tubing hanger to the wellhead or casing hanger, sealing the tubing hanger to the wellhead or casing hanger, and retrieving the tubing hanger form the wellhead. Exemplary prior art tubing hangers and/or running tools for subsea oil well drilling operations are disclosed in U.S. Pat. No. 3,693,714 for "Tubing Hanger Orienting Apparatus and Pressure Energized Sealing Device," U.S. Pat. No. 3,688,841 for "Orienting Tubing Hanger Apparatus," U.S. Pat. No. 3,807,497 for "Orienting Tubing Hanger Apparatus Through Side Pocket Mandrels Can Pass," and U.S. Pat. No. 4,067,062 for "Hydraulic Set Tubing Hanger." Previous tubing hangers generally required means for angularly orienting the tubing hanger with the wellhead, the guidance system, and/or the running tool. Moreover, the operational mode of prior tubing hangers, as exemplified by the above-referenced patents, typically requires that the tubing hanger essentially be retrieved as a unit and does not allow for separate retrieval or the sealing unit of the hanger.

SUMMARY OF THE INVENTION

Briefly stated, the present invention is a tubing suspension technique and system for subsea oil well applications which employs a tubing hanger and/or an associated running tool. The tubing hanger comprises a hanger body which includes an inner body portion having suspension means to support a longitudinally extending tubing string. A lower portion of the hanger has a tranversely disposed landing shoulder. The hanger body also mounts a radially projectable wellhead locking means. Three cooperating concentric sleeves are mounted on the hanger body. A fixed middle sleeve supports radially positionable retainer means. A movable inner sleeve is longitudinally positionable to control the radial position of the retainer means. A retrievable outer sleeve assembly, which has three interconnected sections, is releasably captured by the retainer means. The outer sleeve assembly comprises actuator means for causing the radial projection of the wellhead locking means. The outer sleeve assembly also comprises a radially engageable sealing means and sleeve locking means to secure the outer sleeve assembly to the middle sleeve at a selected longitudinal position. The wellhead locking means, sealing means, and sleeve locking means are actuated by a longitudinally acting load applied to the outer sleeve assembly.

The retainer means preferably includes a plurality of angularly spaced dogs. The sleeve locking means comprises a "wicker thread" extending from the middle sleeve and a spring-loaded segmented nut mounted to the outer sleeve assembly to ratchet over and to engage the "wicker thread". The segmented nut means includes a plurality of angularly spaced wicker dogs secured by means of springs which fail upon application of an upward longitudinal load in excess of a pre-established threshold. The outer sleeve assembly also includes a lower sleeve section having a tapered contact surface Which is engageable for radially projecting a plurality of angularly spaced lock dogs. An intermediate sleeve section mounts a pair of concentric sealing rings.

The running tool for the tubing hanger comprises an inner body having a central longitudinally extending passage. An outer actuating sleeve is concentric with the inner body and longitudinally moveable relative thereto. The actuating sleeve carries first latch dog means for generally radial engagement with the tubing hanger. A second latch means is engageable with a catch means on the actuating sleeve to secure the actuating sleeve at a selective longitudinal position relative to the inner body. A release slide means actuates the second latch means. A hydraulically controlled operator produces relative longitudinal movement between the actuating sleeve and the inner body. A first locking means is concentrically mounted to the inner body and radially extendable for radial locking engagement with the tubing hanger. A second locking means is also concentrically mounted to the inner body and radially extendable for radial locking engagement with the tubing hanger.

Each of the latch dog means preferably includes a plurality of downwardly extending angularly spaced elongated latch dogs having a radially positionable latch end adapted for radial engagement. The release slide assembly comprises a hydraulically controlled longitudinally positionable slide which is engageable with the second latch means for controlling the radial position thereof. The first and second latching means each comprise hydraulically controlled slide members which are engageable with lock rings.

A method for suspending a tubing string from a subsea wellhead in accordance with the present invention comprise employing a tubing hanger to suspend a tubing string, the hanger having a detachable portion which mounts to sealing means. The tubing hanger is landed in the wellhead. A downward longitudinal load is applied to the tubing hanger thereby locking the tubing hanger to the wellhead and activating the sealing means. If necessary, torque may then be applied to the tubing hanger to rotatably thread said hanger into locked engagement with the wellhead. With or without rotation, the tubing hanger will be placed in a fully locked and sealed configuration with the wellhead. An upward longitudinal load may be applied to the tubing hanger to cause release thereof from the wellhead. A hydraulically controlled running tool may be employed to release the detachable portion of the tubing hanger and separately retrieve the detached portion to the surface.

An object of the invention is to provide a new and improved tubing hanger and a running tool for use therewith in suspending a tubing string from a subsea wellhead.

Another object of the invention is to provide a new and improved tubing hanger which is nonorienting and is hydraulically actuable for locking and sealing the hanger to the wellhead housing.

Yet another object of the invention is to provide a new and improved method for completing an undersea tubing suspension system.

A further object of the invention is to provide a new and improved tubing hanger having a seal cartridge for sealing the tubing hanger to the wellhead housing which seal cartridge is separately retrievable from the tubing hanger.

A still further object of the invention is to provide a new and improved tubing hanger and a running tool therefor wherein the running tool may be employed to run the tubing hanger to the wellhead, initially lock and set the seals of the tubing hanger, and retrieve the tubing hanger or the sealing cartridge of the tubing hanger to the surface.

Other objects and advantages of the invention will become apparent from the drawing and the specification.

DETAILED DESCRIPTION

Figure 1:
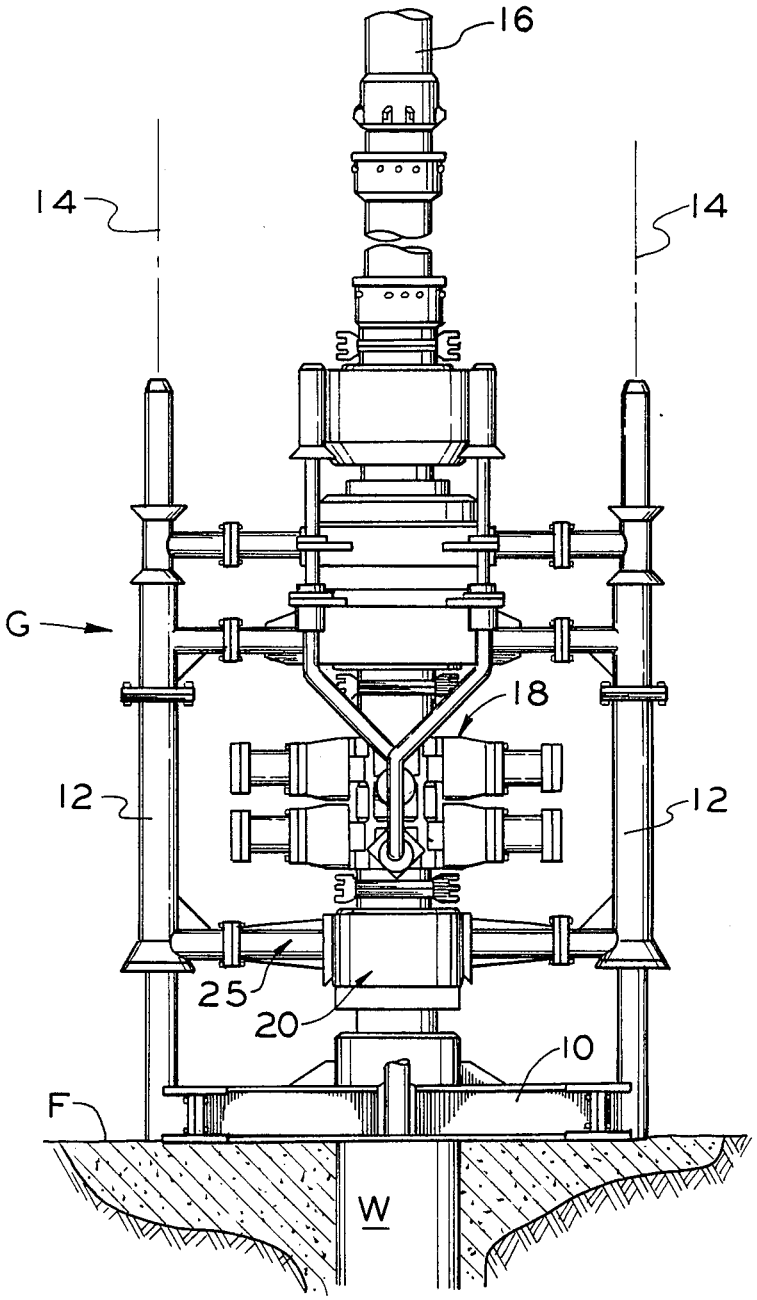
FIG. 1 is a side elevational view of a subsea system used in connection with the drawing and completion of an underwater well bore.
Figure 2A:
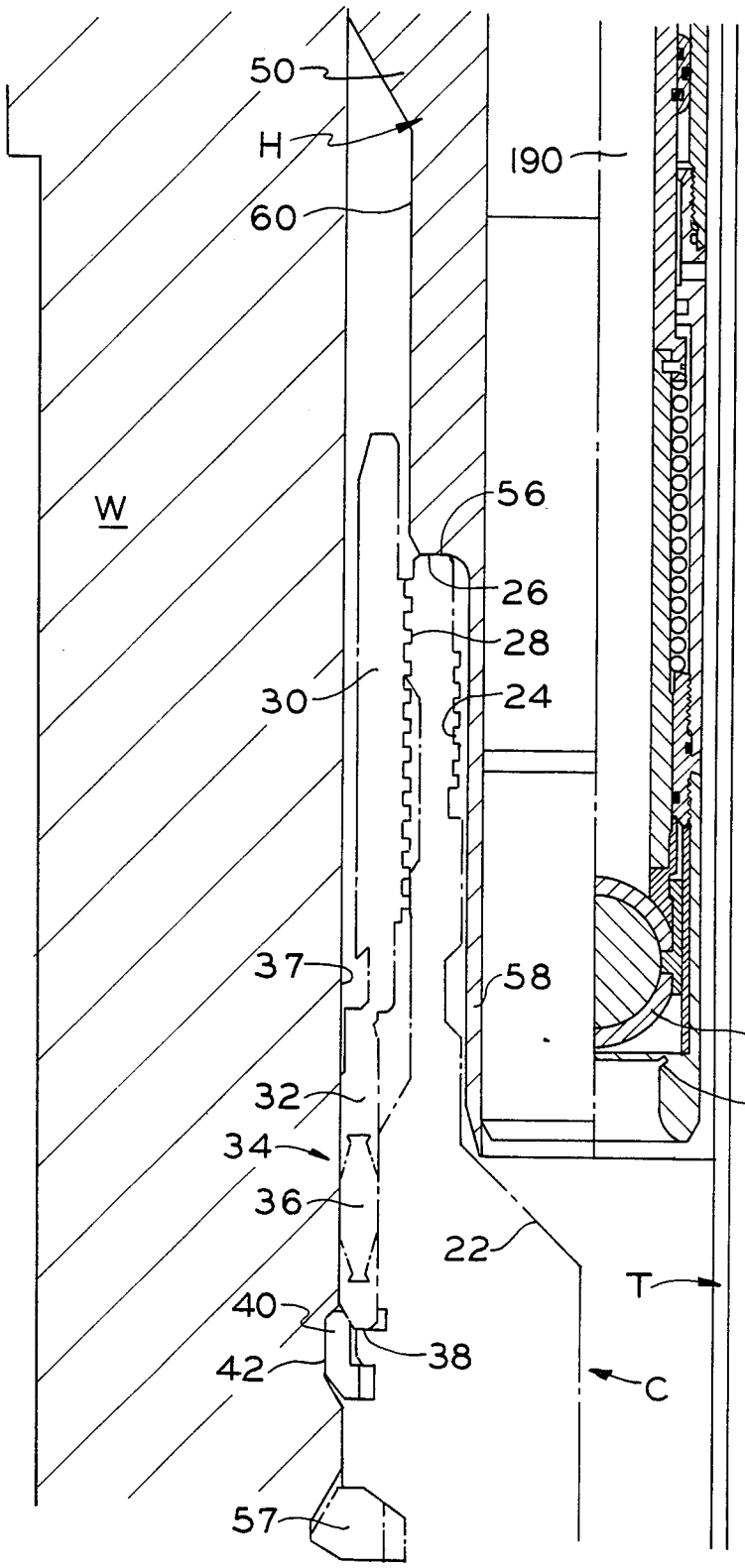
FIGS. 2A, 2B and 2C each show a longitudinal fragmentary section through a portion of the system of FIG. 1 illustrating a tubing hanger in accordance with the present invention landed in a wellhead housing on a casing hanger.
Figure 2B:
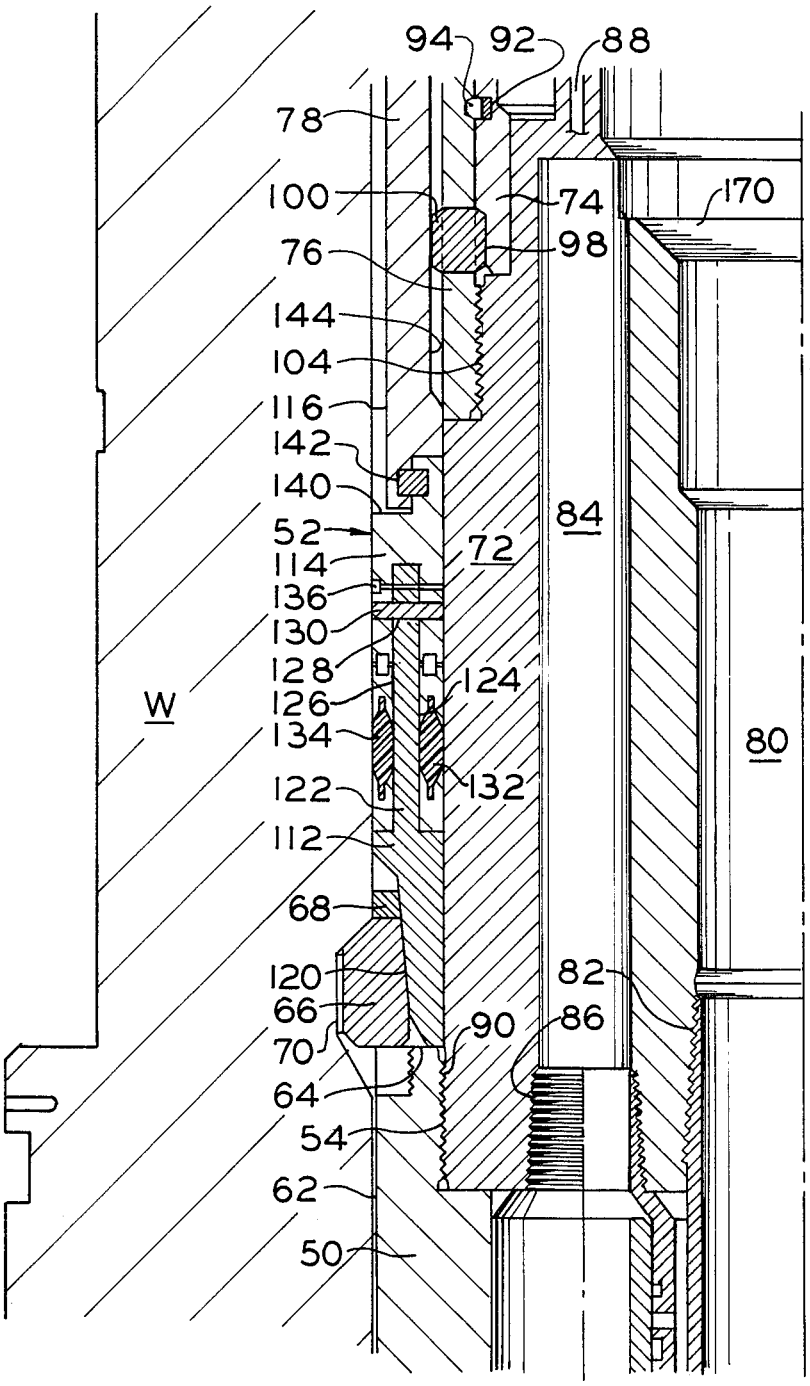
Figure 2C:
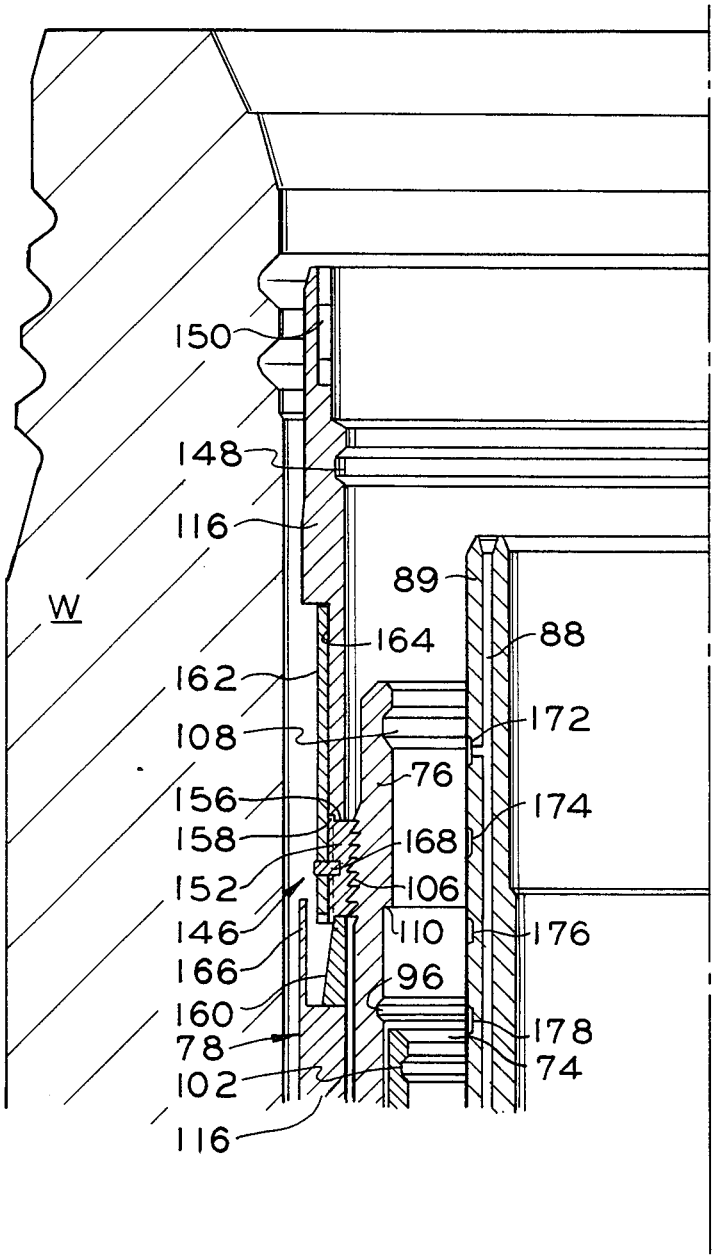
Figure 3A:
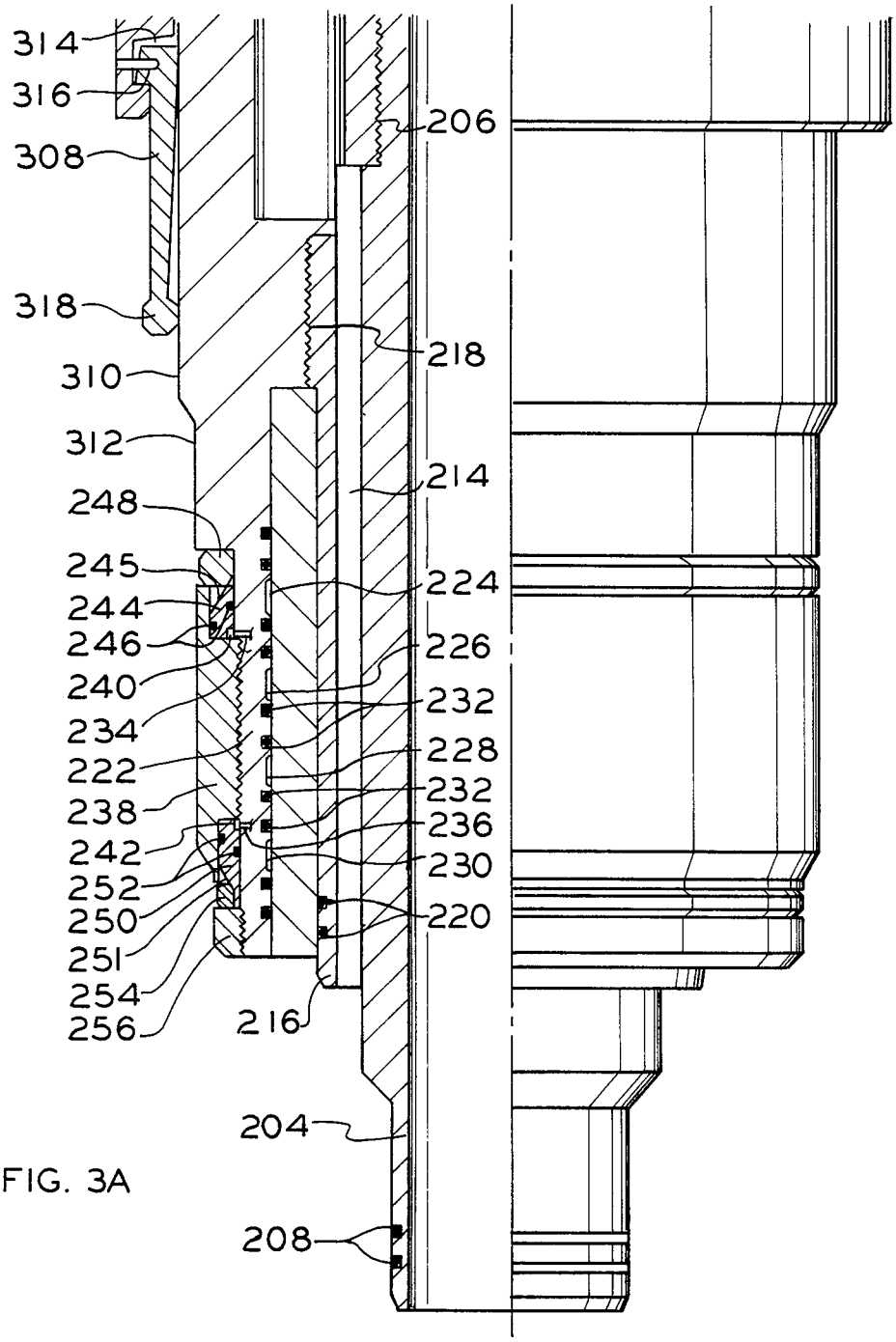
FIGS. 3A, 3B and 3C each show a side elevational view, partly in section and partly broken away, of a running tool which may be employed with the tubing hanger of FIGS. 2A–2C.
Figure 3B:
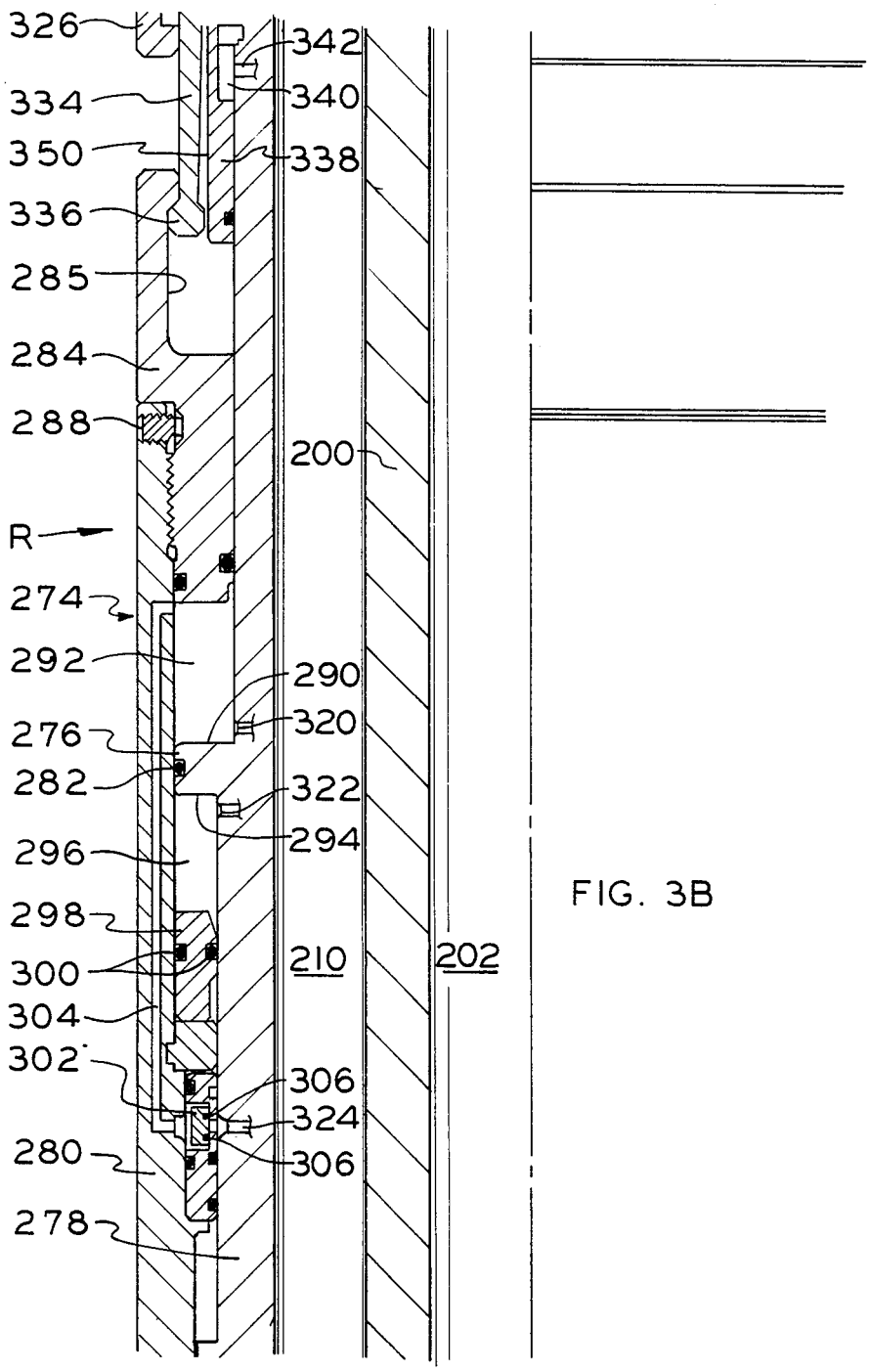
Figure 3C:
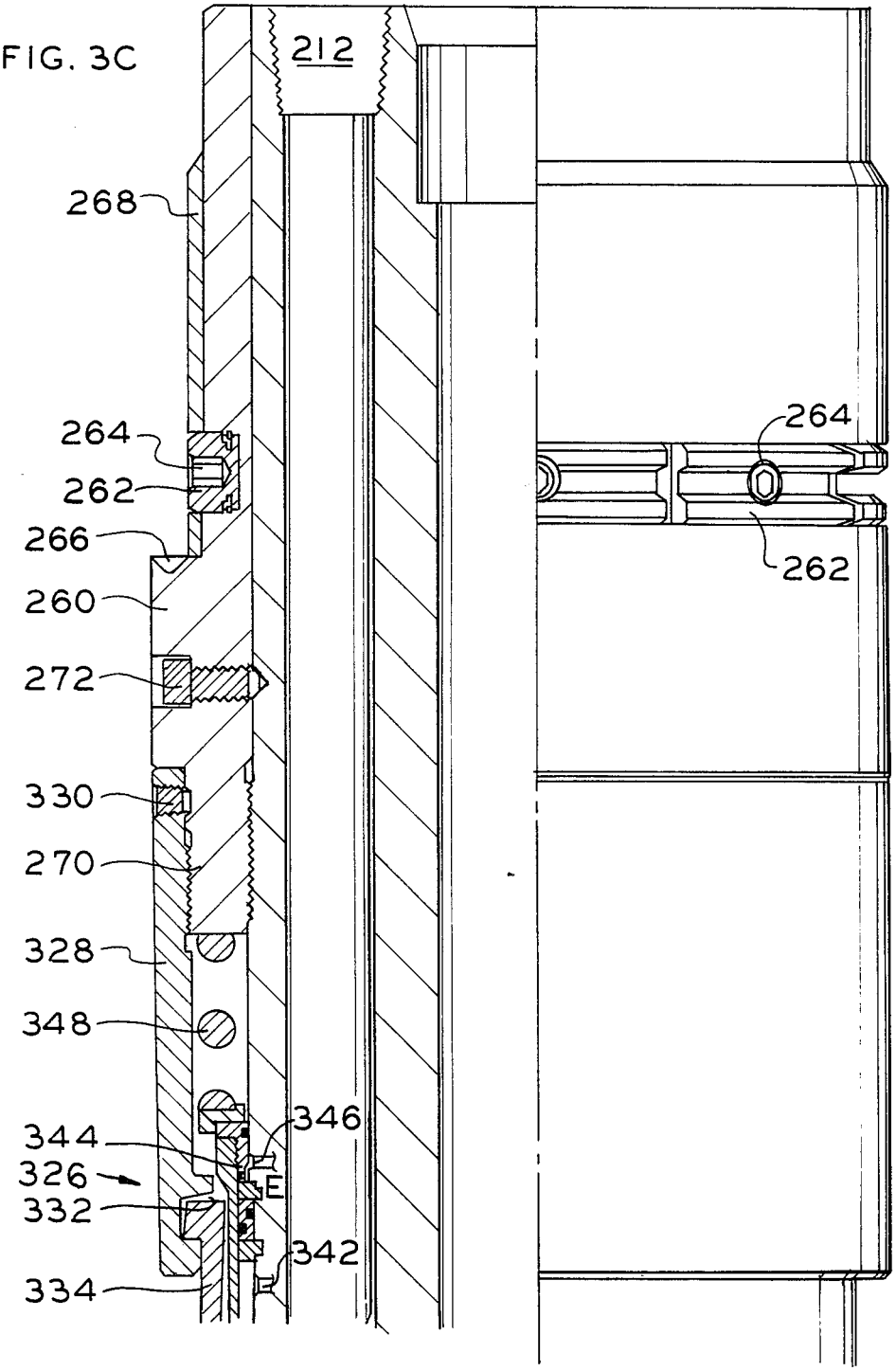
Figure 4:
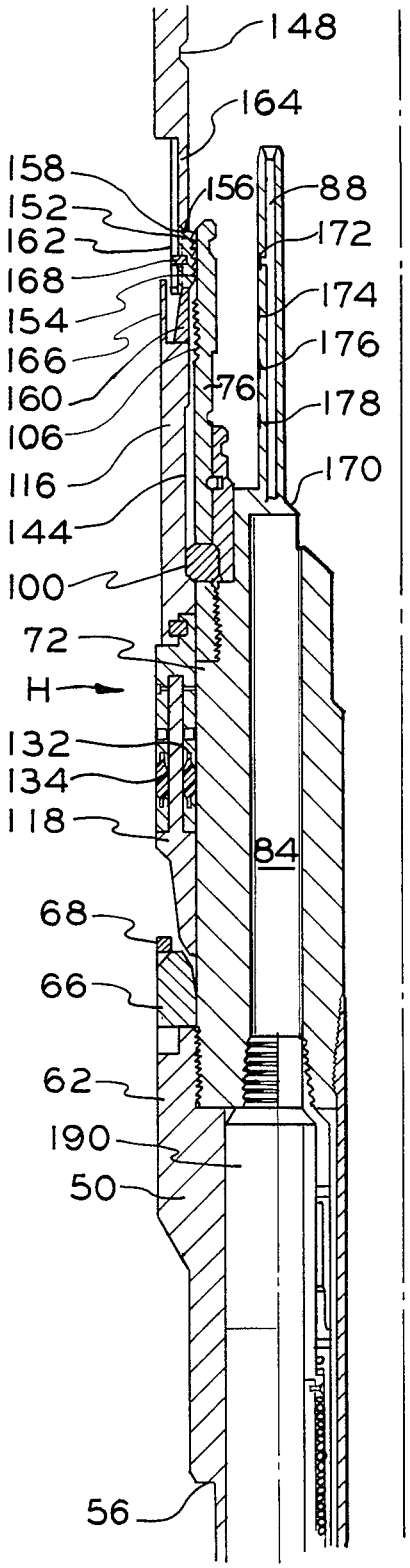
FIG. 4 is a fragmentary sectional view of the tubing hanger of FIGS. 2A–2C illustrating the tubing hanger in an unactivated mode.

With reference to the drawing, wherein like letters and like numerals represent like parts throughout the several figures, the preferred use environment of the tubing suspension system of the present invention is a deep sea oil drilling operation. Referring to FIGS. 2A–2C, a tubing string indicating generally at T is suspended from a novel non-oriented hydraulic set tubing hanger which is indicated generally at H. Tubing hanger H is adapted for landing on a casing hanger C which is suspended in the interior of a wellhead housing W (FIG. 1). Wellhead housing W is affixed at the top of a well bore which is drilled in a formation underlying the floor F of the ocean or sea. The tubing hanger H, in accordance with the invention, may be "run" on a running string from a vessel on the ocean surface, landed on the casing hanger C (FIG. 2C), locked and initially sealed to the wellhead housing W, and retrieved to the surface by means of a novel cooperating tubing hanger running tool R (FIGS. 3A–3C). Wellhead housing W shown in FIG. 1 has an upwardly extending guidance structure G.

Continuing to refer to FIG. 1, guidance structure G is of a conventional form including a base 10 and guide posts 12 which extend vertically upwardly from the corners of the base. Guide posts 12, in a shallow water situation, would secure cables 14 which extend upwardly to a drilling vessel (not illustrated) at the surface of the ocean. A marine riser stack 16 extends upwardly to the drilling vessel at the surface of the water. A blowout preventor stack 18 is positioned at the lower end of the marine riser stack 16. A connector 20 connects the blowout preventor stack 18 to the wellhead housing. Suitable sealing means of conventional form are provided to establish a seal between the connector 20 and the upper end of the wellhead housing W and to establish a seal between the blowout preventor stack 18 and connector 20.

Referring again to FIGS. 2A–2C, casing hanger C is of conventional form and is interiorly suspended from wellhead housing W in a conventional manner. Casing hanger C is the top hanger of a plurality of successive vertically disposed casing hangers mounted in the wellhead housing. Each upwardly succeeding casing hanger supports, in nested fashion, a casing string having a diameter smaller than the adjacent lower hanger. The present invention is preferably adapted for use in conjunction with a Vetco Offshore Inc. type SG-6 $16\frac{3}{4}$ inch X $8\frac{5}{8}$ inch casing hanger. Casing hanger C is adapted to interiorly threadably engage a casing (not illustrated) and includes a conically tapering hanger seat 22, an upper interior thread 24, and an upper casing hanger shoulder 26. Thread 24 is adapted for engagement by a running tool (not illustrated). An upper exterior thread 28 engages a follower nut 30 of a packoff assembly 32. Packoff assembly 32 includes a metal seal assembly, indicated generally at 34, having a resilient compression element 36 which expands to form a metal contact seal extending between the interior surface 37 of wellhead housing W and the exterior surface of casing hanger C. Casing hanger C also includes a reaction shoulder 38 which cooperates with the follower nut 30 to lock the seal assembly in an energized sealing configuration. A lock ring 40 is radially expandable, by the longitudinal movement of the seal assembly, into a locking groove 42 of wellhead housing W. As is conventional for deep water drilling operations, the packoff assembly is also responsive to the pressure of the drilling fluid.

With further reference to FIGS. 2A–2C, tubing hanger H has a two-piece body structure comprising a lower landing collar 50 and an upper tubing hanger body 52 (FIG. 2B). The lower landing collar 50 defines a central hollow region and is externally dimensioned for reception within wellhead housing W and for landing on a hanger casing C as will be described below. Landing collar 50 includes an upper interior threaded portion 54 which provides for threaded engagement of collar 50 with the lower end of upper hanger body 52. Landing collar 50 includes a radially extending circumferential shoulder 56 which is configured so that shoulder 56 rests on casing hanger shoulder 26 upon landing of tubing hanger H on the casing hanger C. When the tubing hanger is landed on casing hanger shoulder 26, the weight of tubing hanger H, tubing string T, and any additional load on tubing hanger H is transferred through casing hanger C directly to the wellhead housing W via a load ring 57, the force being transmitted so as to have a longitudinal and a radial component.

Landing collar 50 further includes a circumferential skirt 58 which extends downwardly from the inner terminus of shoulder 56 to terminate close to the upper portion of casing hanger seat 22. Landing collar 50 additionally includes an intermediate cylindrical portion 60 which is externally dimensioned for accommodating the packoff assembly 32. Cylindrical portion 60 externally tapers from an upper cylindrical portion 62 (FIG. 2B) which is externally dimensioned for close reception in wellhead housing W.

Continuing with a discussion of FIG. 2B, landing collar 50 forms, at the top portion thereof, a support surface 64 for locking/loading dogs 66. Dogs 66 are caged and retained by means of a retaining cage 68 secured to landing collar 50 so that the dogs cannot be lost during running or retrieval operations. In preferred form, eight locking/loading dogs 66 are angularly located at the periphery of tubing hanger H. Dogs 66 are adapted to engage a locking groove 70 which is formed in the wellhead housing W. When the dogs 66 are radially projected to a locked position they function to transfer upward loads on tubinghanger H to the wellhead housing W. It should be noted that, because each dog 66 is a separate locking unit, substantially the only loading placed on the dogs is the bearing load resulting from the engagement with the wellhead locking groove 70. No circumferential stresses are placed on dogs 66 by radially forcing the dogs to the extended locked position.

Upper tubing hanger body 52 includes a central tubing hanger body 72 and three cooperating concentric sleeves: an inner actuating sleeve 74, a fixed middle sleeve 76, and an outer actuator sleeve 78 comprising a seal/lock cartridge. Body 72 may be fabricated as a unitary forging. A central axially extending production bore 80 is machined into body 72. Production bore 80 includes a lower outwardly flared, interiorly threaded connector portion 82 for engagement with tubing string T. In a typical application tubing hanger H is adapted for suspending tubing having a 4½ inch outside diameter, weighing 12.75 pounds per linear foot and having any required length as may be required. One or more axially extending bores 84, having an interiorly threaded flaring connector portion 86, are also machined into body 72. Tubing body 72 further includes hydraulic control line defining bores 88. In a preferred form, four axially extending hydraulic control line bores 88 extend through a control line extension 89 (FIG. 2C). An exterior threaded surface 90 is provided at the lower circumferential portion of body 72 for engagement with threaded portion 54 of landing collar 50.

Figure 10:
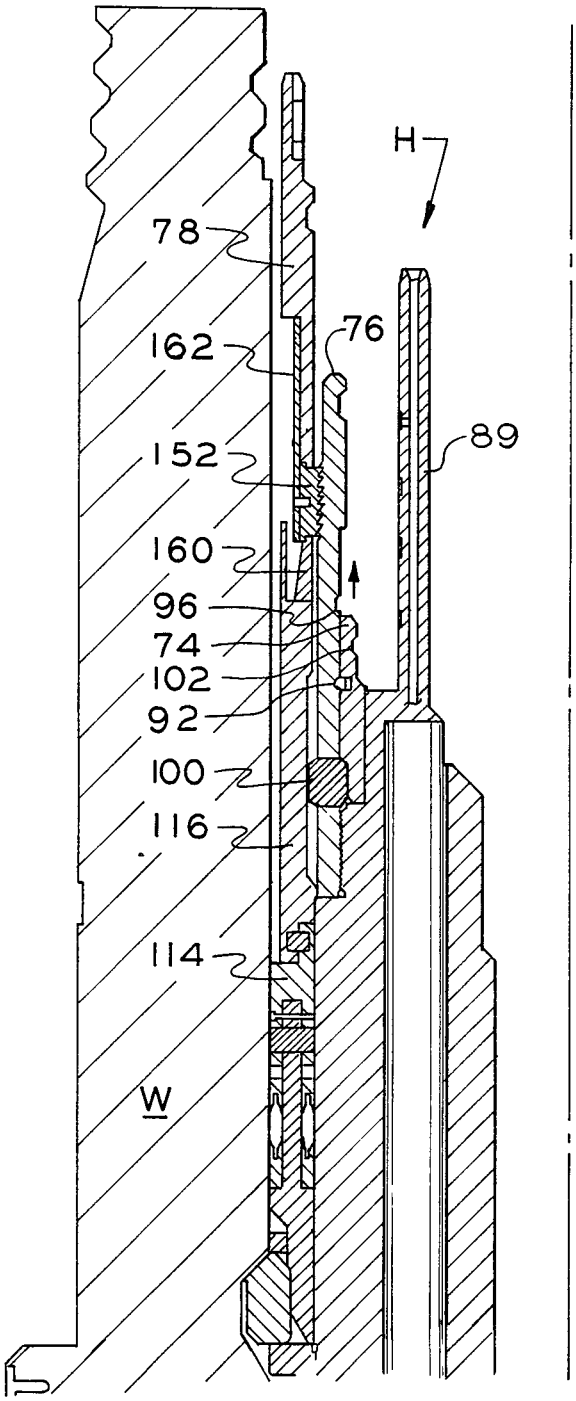
FIG. 10 is a fragmentary sectional view of the tubing hanger of FIGS. 2A–2C illustrating the tubing hanger in a releasing mode permitting the separate retrieval of a seal/lock unit.

Inner actuating sleeve 74 is radially retained between a portion of body 72 having a reduced external diameter and middle sleeve 76. Inner sleeve 74 is longitudinally moveable between an upper and a lower position to control the position of a set of loading dogs as more fully described below. Inner sleeve 74 locates, at an intermediate longitudinal position, a peripherally extending retainer ring 92. Retainer ring 92 is adapted for reception in a lower locking groove 94 formed in the interior of fixed middle sleeve 76 to retain the inner sleeve 74 in the lower locked position illustrated in FIG. 2. Retainer ring 92 is also adapted for reception in an upper locking groove 96 (FIG. 2C) of middle sleeve 76 to retain inner sleeve 74 in an upper release position. A peripheral lower portion of inner sleeve 74 forms a lower hearing surface 98 which interacts with radially positionable seal cartridge retainer dogs 100. The retainer dogs 100 function to support the weight of the tubing hanger H and tubing string T during running and retrieval and to retain a separately retrievable seal/lock cartridge as described below. Inner sleeve 74 is operable by the tubing hanger running tool R to function as an actuator for retainer dogs 100. When inner sleeve 74 is in the lower position as illustrated in FIG. 2, retainer dogs 100 are locked in an extended radial position. When inner sleeve 74 is in the upper position, i.e. retainer ring 92 is positioned in locking groove 96 as illustrated in FIG. 10, retainer dogs 100 are free to retract inwardly. An interior circumferentially extending locking groove 102 (FIG. 2C) is formed near the top of inner sleeve 74 for engagement with running tool R.

Middle sleeve 76 is fixed to body 72 by a lower interior threaded connection 104. Middle sleeve 76 functions as an anchor for running tool R when the outer actuation sleeve 78 is actuated as described below. Middle sleeve 76 has a plurality of angularly spaced windows, which accommmodate radially moveable retainer dogs 100, and an outer wicker thread 106 (FIG. 2C). An interior locking groove 108 is formed near the top end of middle sleeve 76. Locking groove 108 is engaged by running tool R as described below. Middle sleeve 76 is also interiorly configured to provide a stop shoulder 110 which limits the upward motion of inner sleeve 74.

Outer sleeve 78 functions in part as a seal/lock cartridge assembly and comprises three interconnected sections: a lower lock actuating section 112, a middle seal cartridge section 114, and an upper seal and lock actuator section 116. The lower section 112 functions as an actuator for the locking/loading dogs 66. Lower section 112 includes an inwardly tapering actuating sleeve 118. Actuating sleeve 118 has a slightly tapered external contact surface 120 which preferably has approximately a 4° taper to provide for a positive locking engagement against locking/loading dogs 66 when the dogs are urged by the downwardly forced actuating sleeve 118 to the radially extended lock position. An annular tongue 122 extends upwardly from sleeve 118 to define an inner reaction surface 124 and a concentric outer reaction surface 126. Tongue 122 includes a plurality of angularly spaced longitudinally extending radial slots 128 which receive pins 130 for connecting lower sleeve section 112 to middle section 114. The foregoing pin/slot arrangement allows for limited relative longitudinal movement between the lower and middle sections while assuring that the sections cannot be separated.

The middle section 114 of outer sleeve 78 carries two elastomer seal rings 132 and 134. The upper portion of lower section 112 and the lower portion of middle section 114 interconnect in tongue and groove fashion, i.e., tongue 122 fits between seal rings 132 and 134. Each of the seal rings includes an internal resilient compression member which radially expands under a longitudinal compression force. The radial expansion of the compression members forces metal seal lips on each side of the seal rings into sealing contact with the adjacent surfaces. Thus, in response to a longitudinal compressive force resulting from application of a load on lock actuator sleeve section 116, seal ring 132 forms a metal-to-metal seal between cylindrical reaction surface 124 and body 72 of tubing hanger H, and seal ring 134 forms a metal-to-metal seal between wellhead housing W and cylindrical reaction surface 126. Shear pins 136 are inserted through middle section 114 and tongue 122 to prevent premature expansion of the seal rings 132 and 134. Middle sleeve section 114 has an upper landing-/loading shoulder 140 which provides a landing and loading surface for a hydraulic setting tool. A connector 142 connects the upper end of the middle sleeve section 114 to the lower end of upper sleeve section 116. Connector 142 function as a bearing member which transmits longitudinal tensile and compressive loads to middle sleeve section 114 and permits the rotation of upper sleeve section 116 when the upper section is subjected to a load. The upper sleeve section 116 includes a sleeve portion forming an intermediate, longitudinally extending, interior recess 144 which accommodates the radially extended retainer dogs 100 and allows for limited longitudinal movement of sleeve section 116 relative thereto. Upper section 116 also includes, adjacent the top thereof, a plurality of J-shaped slots 150 (FIG. 2C) which are adapted to be engaged by a hydraulic setting tool. An interior circumferential lock groove 148 is also provided in upper section 116 for engagement with running tool R as described below.

Referring now to FIG. 2C, upper sleeve section 116 further includes a wicker dog assembly designated generally by the numeral 146. Wicker dog assembly 146 provides a means for partially actuating the locking-/loading dogs 66, this actuating means having a mechanical override capability. Wicker dog assembly 146 is responsive to a longitudinally acting force provided by running tool R. A hydraulic set running tool (not illustrated) may be employed for exerting any additional longitudinal force which may be required to fully activate the seal rings 132 and 134, and to rotate outer sleeve 78, to "set" the seals and establish locking engagement between the tubing hanger and the wellhead housing. Wicker thread 106 of wicker dog assembly 146 has a ramp profile. Wicker dog assembly 146 also includes a spring-loaded segmented nut 152. When a downward longitudinal force is applied to segmented nut 152, the nut ratchets over wicker thread 106. Only a slight rotation is subsequently required to fully seat and load nut 152. Segmented nut 152 is comprised of an assembly of individual dogs which are cut from specific arcuate portions of a machined continuous ring which is interiorly threaded. The wicker dogs must be maintained in correct angular sequence when the dogs are reassembled and installed in the outer sleeve in order to maintain thread continuity. Shoulders are machined in the dogs to act as retainers and guides. Angularly spaced windows 156 are formed in the outer sleeve section 116. Windows 156 are dimensioned to be approximately twice the length of each of dogs and slightly wider than the width of each dog. The dogs rest against shoulders 158 which are flat and parallel to the longitudinal axis of the outer sleeve. A frustroconical ramp 160 slopes downwardly from longitudinal shoulders 158 away from the central longitudinal axis of the outer sleeve 78. Ramp 160 functions to guide the dogs away from the fixed thread 106 to permit movement of the seal/lock cartridge of the outer sleeve assembly.

Each wicker dog of nut 152 is secured in place by means of a cantilever mounted leaf spring 162 having an intermediate narrow notched section. The outer sleeve includes a recess 164 which receives each of the springs 162. The springs are secured to the outer sleeve by screws (not illustrated). The outer portions of the dogs are provided with recesses for receiving the lower ends of springs 162. Each dog is secured to the spring by means of a pin 168. The springs permit the dogs to ratchet over the fixed threads 106 when the outer sleeve is forced longitudinally downward as more fully described below.

The seal/lock cartridge, consisting essentially of the outer sleeve assembly, and/or the entire tubing hanger are retrievable by applying an upward load to the tubing hanger running tool R. At a predetermined load, the springs 162 will fail resulting in freeing of the dogs of nut 152. Ramp 160 will guide the freed dogs away from fixed thread 106 thus allowing the outer sleeve 78 to be moved relative to the fixed middle sleeve. Thereafter, inner sleeve 74 may be pulled upwardly to allow dogs 100 to retract inwardly. The lock/seal can then be removed or retrieved separately. A retainer sleeve 166 is welded to the outer sleeve to retain the wicker dogs of nut 152 during retrieval of the outer sleeve.

Hanger body 72 forms a central bowl 170 having a 45 degree frustoconical shape to reduce the collection of debris. It will be appreciated that the interface between the tubing hanger H and the production bore and annulus bore extension subs may be described as a box-up, pin-down interface. Hydraulic control line bores 88 communicate with radially extending lines which terminate in longitudinally spaced circumferentially extending grooves 172, 174, 176, and 178.

Referring again to FIG. 2A, an annulus control valve 190 is received in annulus bore 84 and threadably connected at connector portion 86. Annulus control valve 190 includes a spring biased metal ball 192 which cooperates with seat 194 to form a metal-to-metal seal. Valve 190 is hydraulically controlled, is provided with a fail-safe closing spring and valve 190 has an override capability so that completion fluid can be pumped downhole through the valve without hydraulically opening the valve.

It will be appreciated that the tubing hanger H described above is completely nonorienting with respect to the casing hanger H, the wellhead housing W, and the guidance structure G. In other words, a specific angular orientation is not required to land, lock and seal the tubing hanger at the subsea wellhead.

With reference to FIGS. 3A–3C, a hydraulic set nonorienting tubing hanger running tool R, adapted to be employed in conjunction with tubing hanger H, is shown. Tool R is used to run, land, lock, seal and retrieve tubing hanger H. Running tool R is run on a tubing string inside the drilling riser and is preferably suitable for deepwater operations at depths as great as 7,500 feet. Running tool R comprises an inner cylindrical body 200 which defines a central longitudinally extending tubing passage 202. Passage 202 is connectable by means of a concentric production bore seal sub 204 to production bore 80 of the tubing hanger. Production bore seal sub 204 is a sleeve-like member having, at an upper end, an external circumferential threaded portion 206 which threadably engages a complementary threaded connector portion interiorly formed in cylindrical body 200. Seal sub 204 tapers at the lower end to form an external configuration which is adapted for accommodation in production bowl 170 of tubing hanger H. A pair of O-rings 208 are mounted in circumferential dove-tail grooves at the lower portion of seal sub 204 to provide a seal against the interior portion of production bowl 170 upon reception of the running tool by the tubing hanger as described below.

Cylindrical body 200 also includes a longitudinally extending annular bore 210 having, at the upper end thereof, an interior flared threaded connector portion 212. Annular bore 210 is in communication, at its lower end, with a transition annulus 214 formed between the exterior of seal sub 204 and the interior of a concentric annulus access seal sub 216. Annulus access seal sub 216 is a sleeve-like member having an upper threaded end 218 which engages a complementary threaded connector portion interiorly formed in cylindrical body 200 at a location which is radially and longitudinally displaced from the threaded engagement connection with seal sub 204. A pair of O-rings 220 are received in parallel circumferential grooves at the lower portion of seal sub 216 to form a seal against the interior surface of control line extension 89 (see FIG. 2C) of tubing hanger H.

The lower end of cylindrical body 200 is configures to form a circumferential skirt 222 which is concentric with seal sub 204 and seal sub 216. Skirt 222 cooperates with the exterior of seal sub 216 to form an annular recess which receives control line extension 89 of tubing hanger H. Skirt 222 has four parallel circumferentially extending grooves 224, 226, 228, and 230 in its interior surface. Grooves 224, 226, 228, and 230 mate with corresponding grooves 172, 174, 176, and 178 of the tubing hanger to form four annular fluid passages. Each of the grooves is provided with an upper and a lower O-ring 232. Grooves 224 and 226 communicate with a fluid passage leading to port 234 and grooves 228 and 230 communicate with a fluid passage leading to port 236.

Skirt 222 is provided with an intermediate external threaded portion for securing an actuator sleeve 238. In cooperation with the exterior of skirt 222, actuator sleeve 238 forms at an upper interior portion an upper hydraulic chamber 240. Actuator sleeve 238 also forms at an interior lower portion, in cooperation with the exterior of skirt 222, a lower hydraulic chamber 242. Chamber 240 is in fluid communication via port 234 with hydraulic control lines. Chamber 242 is in communication via port 236 with hydraulic control lines. An annular slide 244 having an upper outer inclined surface 245 is longitudinally moveable in chamber 240. Slide 244 is provided with O-rings 246 which seal the slide against the exterior of skirt 222 and the interior of sleeve 238. Inclined surface 245 is engageable against an interior portion of a peripherally located lock ring 248 so that the lock ring may be radially expanded from its normally inwardly retracted configuration in response to the upward longitudinal movement of the hydraulically controlled slide 244. Similarly, an annular slide 250 having a lower outer inclined surface 251 is received in chamber 242. Slide 250 has O-rings 252 which seal against the exterior of skirt 222 and the interior of sleeve 238 to provide for longitudinal hydraulically controlled movement of slide 250 in chamber 242. Inclined surface 251 engages an interior portion of a peripherally located seal actuator ring 254 so that downward longitudinal movement of slide 250 results in the radial expansion of ring 254 from its normally inwardly retracted positon. The retracted and expanded diameters of ring 248 are greater than the corresponding diameters of ring 254. A retainer ring 256 is threaded at the lower exterior of skirt 222 to retain the lower piston/seal actuator ring assembly. Lock ring 248 is adapted for locking engagement in locking groove 108 of the fixed middle sleeve 76 of tubing hanger H, and seal actuator ring 254 is adapted for locking engagement in locking groove 102 of the inner actuator sleeve 74. The lower exterior portions of skirt 222 and actuator sleeve 238 are configured for internal reception against sleeves 74 and 76.

An upper support sleeve 260 (FIG. 3C) is secured around the upper exterior of cylinder body 200. Support sleeve 260 securely mounts a plurality of peripheral angularly spaced connector members 262. Connector members 262 include sockets 264 for receiving dog screws (not illustrated) for securing a completion riser (not illustrated). A V-shaped recess 266 is formed for receiving the lower end of the completion riser. A longitudinally extending orientation rib 268 extends outwardly from sleeve 260. The downhole end of support sleeve 260 forms a connector skirt 270 having a reduced outer diameter and concentric cylindrical exterior and interior threaded surfaces. The interior threaded surface threadably engages an external threaded portion of cylindrical body 200 to secure sleeve 260 to cylindrical body 200. Support sleeve 260 is further secured in fixed position relative to the cylindrical body 200 by means of angularly spaced threaded fasteners 272.

An outer actuating sleeve assembly designated generally by the numeral 274 (FIG. 3B) is disposed for controlled longitudinal movement at the outer portion of the running tool R below support sleeve 260 and generally concentrically of cylindrical body 200. A shoulder 276 radially projects from an intermediate portion of cylindrical body 200 to form at the periphery an internal retention rim for an outer actuating sleeve 280. A second radially projecting shoulder 278 which is spaced longitudinally downwardly from shoulder 276 also functions to inwardly retain actuator sleeve 280. Actuator sleeve 280 is hydraulically controlled to provide for coordinated longitudinal movement relative to cylindrical body 200 as described below. Shoulder 276 mounts a peripherally projecting O-ring 282 which seals against the interior of actuator sleeve 280.

At an upper portion actuator sleeve 280 interiorly threadably engages a latch sleeve 284. Latch sleeve 284 forms an upper interior latch sleeve recess 285 partially defined by the exterior of cylindrical body 200. A circumferentially extending latch groove 286 is formed at an upper interior portion of recess 285. A plurality of angularly spaced fasteners 288 secure actuator sleeve 280 to latch sleeve 284 so that sleeves 280 and 284 longitudinally move in tandem.

Shoulder 276 forms an upper reaction surface 290. Surface 290, an exterior portion of cylindrical body 200, an interior portion of actuator sleeve 280, and the bottom surface of latch sleeve 284 form a first annular hydraulic chamber 292. Shoulder 276 also forms a lower reaction surface 294 which partially defines a second annular hydraulic chamber 296. Second chamber 296 receives a floating piston 298. O-rings 300 seal piston 298 with the chamber walls defined by portions of actuator sleeve 280 and cylindrical body 200.

A check valve 302 is disposed below second chamber 296. Check valve 302 provides a valve means to control the passage of fluid through a hydraulic passage 304 formed in sleeve 280. Passage 304 communicates with first chamber 292. Check valve 302 is carried by longitudinally moveable actuator sleeve 280. O-rings 306 are provided for sealing the check valve against exterior wall portions of cylindrical body 200 and interior wall portions of actuator sleeve 280.

Cylindrical body 200 includes longitudinally extending control lines communicating with radially extending hydraulic passages. One passage forms a port 320 which opens into first chamber 292. A second hydraulic passage forms a port 322 which opens into second chamber 296. A third passage forms a port 324 which is alignable with check valve 302 or the lower portion of chamber 296 in accordance with the longitudinal position of sleeve 280.

Figure 5:
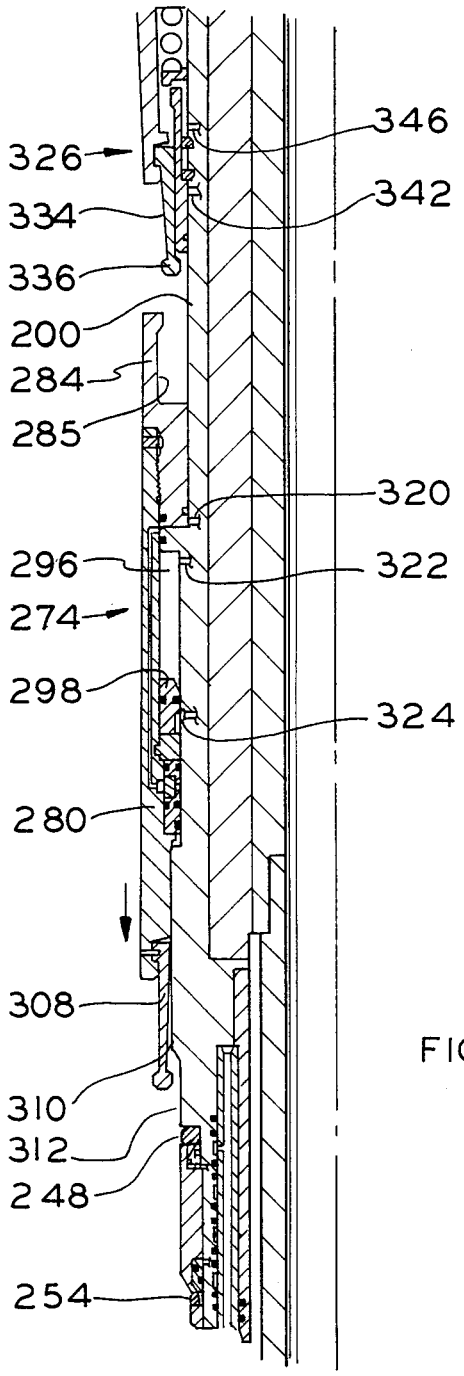
FIG. 5 is a fragmentary sectional view of the running tool of FIGS. 3A–3C illustrating an outer actuating sleeve portion in a release mode.

The lower portion of actuator sleeve 280 forms an interior recess 314 which captures the upper connecting ends of elongated and pivotally mounted latch dogs 308. The angularly spaced latch dogs 308 each have a lower engagement end 318 which is adapted for locking reception in lock groove 148. The upper connecting ends of the spacially separated latch dogs 308 are connected to actuator sleeve 280 by pins 316. The latch dogs 308 function to provide a radially retained locking means. The latch dogs extend downwardly from sleeve 280 and are carried longitudinally with sleeve 280. The inner surfaces of the engagement ends 318 of latch dogs 308 interact with selective longitudinal portions of the exterior surface of the cylindrical body 200 to position the latch dogs in a lock or unlock mode in accordance with the longitudinal position of sleeve 280 relative to body 200. Shoulder 278 forms a downwardly extending, cylindrical locking surface 310 which defines, upon interaction with the engagement ends 318 of latch dogs 308, a radially extended inner limit to the radial position of the engagement ends of the pivotal latch dogs 308. When the actuator sleeve is longitudinally moved to a lowered position such as illustrated in FIG. 5, the inner surfaces of the engagement ends 318 are free to ride the tapered portion to bear against a cylindrical release surface 312 having a reduced diameter. The engagement ends 318 are thus free to pivot inwardly out of radial engagement with lock groove 148.

Actuator sleeve 280 is secured in the upper locked position illustrated in FIG. 3B wherein the latch dogs are retained in a lock mode by means of an upwardly disposed release slide assembly designated generally by the numeral 326. Release slide assembly 326 comprises a release slide sleeve 328 which engages the lower exterior threaded portion 270 of support sleeve 260. A plurality of angularly spaced fasteners 330 further secure sleeve 328 at a fixed longitudinal position to support sleeve 260. Sleeve 328 forms at a lower interior portion a retainer recess 332 for capturing the upper connector portions of elongated pivotal latch dogs 334. Latch dogs 334 are substantially similar to latch dogs 308. The engagement ends 336 of latch dogs 334 have outer portions which are adapted for engagement in latch groove 286 to secure the actuator sleeve 280 in the upper locked position illustrated in FIG. 3B. The radial position of each engagement end 336 is governed by a release slide 338. An outer reaction surface 350 of the release slide is selectively engageable against the interior surfaces of engagement end 336 to radially limit the engagement end to the extended locked position.

The engagement ends 336 of latch dogs 334 are radially retained between the latch sleeve and the release slide. Release slide 338 is hydraulically controlled for longitudinal movement. Release slide 338 defines, by cooperation with an external portion of cylindrical member 200, a lower slide chamber 340. A radially extending hydraulic control passage forms a port 342 which opens into chamber 340. Release slide 338 also forms an upper slide chamber 344 which is also partially defined by cylindrical member 200. A radially extending hydraulic control line forms a port 346 which opens into upper slide chamber 344. It will be appreciated that the relative hydraulic pressure in chambers 340 and 344 will control the longitudinal position of release slide 338. A mechanical override means 348 is also provided to override the hydraulic pressure controlled position of the release slide. Upon the upward longitudinal displacement of the release slide relative to the position of FIG 3B, the latch dogs 334 are free to pivot inwardly and to thus release engagement with the latch sleeve 284.

A tubing suspension system in accordance with the present invention is provided by connecting the tubing hanger H to the running tool R. The running tool and tubing hanger are then "run" to the wellhead W where tubing hanger H is landed on casing hanger C. The tubing hanger is then locked to the wellhead housing. The seals between the wellhead housing and the tubing hanger are initially activated and the seals tested. The running tool R is then released from the tubing hanger and retrieved to the surfaces. If necessary, an HR setting tool is run to the wellhead to additionally set the seals between the tubing hanger and the wellhead housing. The running tool R may then be re-run to test the tubing hanger seals. If the tests are successful, the running tool is released from the tubing hanger and retrieved. The seal/load cartridge of the tubing hanger may be separately retrieved or the entire tubing hanger may be retrieved. A manual override means is provided to retrieve the tubing hanger in the event of the loss of hydraulic pressure prior to disconnecting the running tool R from the tubing hanger H.

The running tool R and tubing hanger H are connected on the drill floor prior to running. Before connecting the tubing hanger to the running tool for running, the inner sleeve 74 is positioned in the lower position illustrated in FIGS, 2B, 2C so that retainer ring 92 is received in lock groove 94 and the retainer dogs 100 are fully extended by the engagement of bearing surface 98. The outer actuating sleeve 78 of the tubing hanger will at this time be in an upward longitudinal position wherein the wicker dogs 154 are completely disengaged from wicker thread 106 and generally longitudinally upwardly displaced therefrom. The locking/loading dogs 66 will be fully retracted to the inward radial position.

Figure 6:
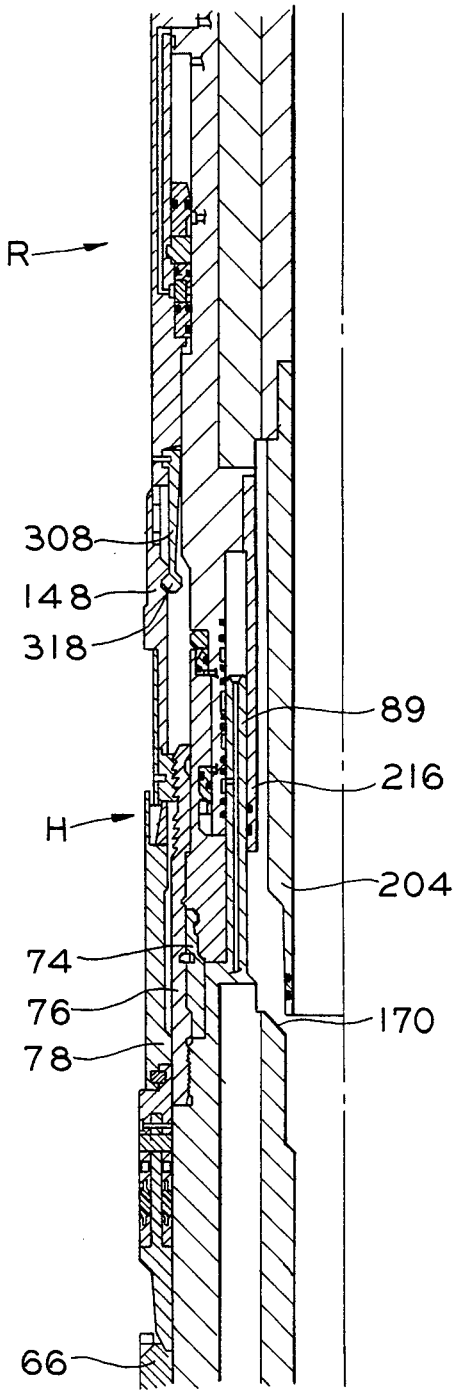
FIG. 6 is a fragmentary sectional view showing the running tool of FIGS. 3A–3C in the running mode landed on the top of the tubing hanger of FIGS. 2A–2C.
Figure 11:
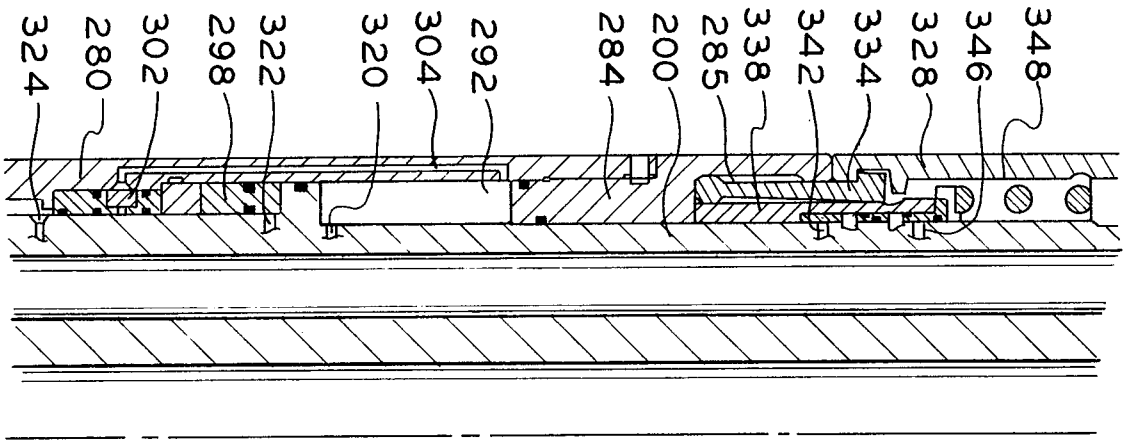
FIG. 11 is a fragmentary sectional view illustrating the running tool of FIGS. 3A–3C in a retracted mode.

The tubing hanger is connected to the running tool by first pressurizing upper slide chamber 344 through port 346 to lift release slide 338. Latch dogs 334 will pivot inwardly so as to be released from latch groove 286 of the lower cylinder latch sleeve 284 as illustrated in FIG. 5. Port 322 is pressurized so that the floating piston 298, acting in hydraulic chamber 296, forces outer actuating sleeve 280 downwardly to the position illustrated in FIG. 5. All of the other ports are vented. The running tool R and tubing hanger H are axially aligned and the running tool is lowered onto the tubing hanger. The outer actuating sleeve assembly 274 essentially rests on the outer sleeve 78 of tubing hanger as illustrated in FIG. 6. Port 322 is then vented and the pressure at port 346 is maintained while port 320 is pressurized. The pressurization of port 320 results in latch sleeve 284 being upwardly expelled from hydraulic chamber 292 so that outer actuating sleeve 280 is forced upwardly until the upper end of sleeve 284 contacts the lower end of sleeve 328 as illustrated in FIG. 11. Port 346 is vented and port 342 is pressurized so that release slide 338 is forced downwardly by the pressure in slide chamber 340. Reaction surface 350 forces the engagement ends 336 of latch dogs 308 against the interior of latch sleeve 284. Hence, the outer actuating sleeve 280 is locked to the upper sleeve. All of the ports are then vented and the running tool is lifted to verify that the tubing hanger and the running tool are locked.

It should be appreciated that the lock actuator sleeve latch dogs 308 are now secured in lock groove 148 of the tubing hanger since the engagement ends 318 of the latch dogs 308 engage cylindrical lock surface 310 of the running tool body. The foregoing configuration allows for the tubing hanger and running tool to be run without hydraulic control pressure. The weight of the tubing hanger H and the tubing string T will force the outer actuating sleeve 280 to a longitudinally downward extended position.

Figure 8:
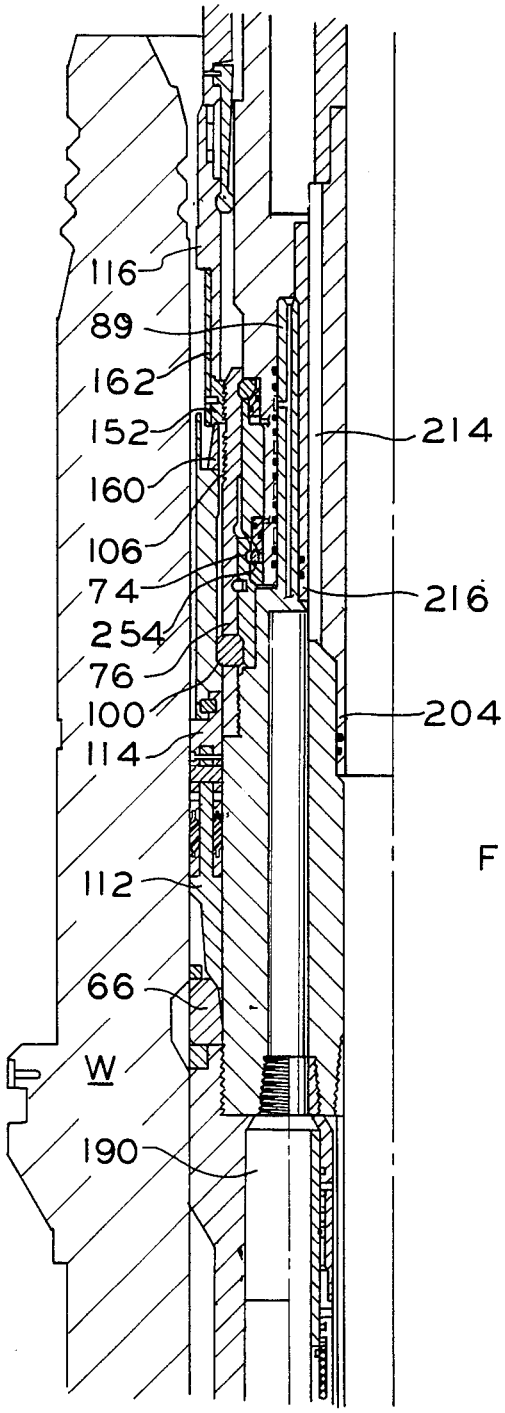
FIG. 8 is a fragmentary sectional view illustrating the tubing hanger of FIGS. 2A–2C unlocked from the wellhead.

The tubing hanger is run until it approaches the blowout preventor stack 18 of guidance structure G. Before the tubing hanger enters stack 18, the tubing hanger and running tool are stopped and all of the control lines to the running tool and the tubing hanger are connected. Port 320 is then pressurized forcing latch sleeve 284 upwardly from hydraulic chamber 292 until the lower end of release slide sleeve 328 and the upper end of latch sleeve 284 essentially come into contact. Outer actuating sleeve 280 is thus in a retracted position as illustrated in FIG. 11. Port 234 is pressurized so that slide 244 is upwardly expelled from upper hydraulic chamber 240. The inclined surface 245 of slide 244 wedges lock ring 248 radially outwardly for locking engagement in locking groove 108 of the fixed middle sleeve 76 of the tubing hanger as illustrated in FIG. 8. The balance and control ports to the production bore valve (not illustrated) and the annulus control valve 190 in the tubing hanger and the annulus bore check valve in the running tool (not illustrated) are then pressurized.

Figure 7:
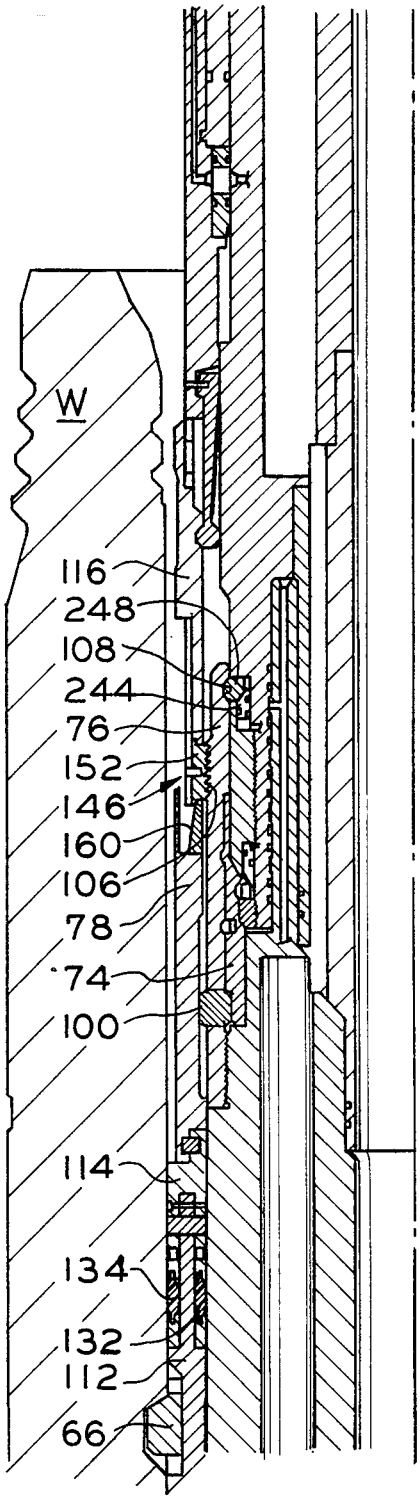
FIG. 7 is a fragmentary sectional view depicting the running tool of FIGS. 3A–3C in the locking mode landed in the tubing hanger of FIGS. 2A–2C.
Figure 9:
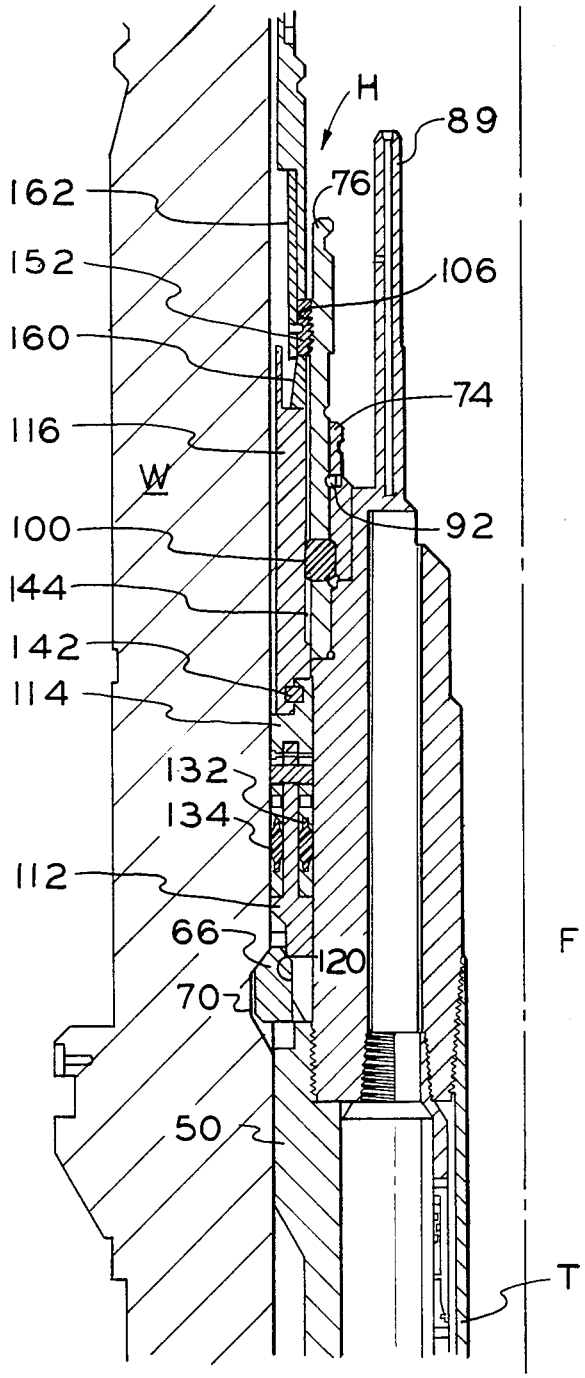
FIG. 9 is a fragmentary sectional view the tubing hanger of FIGS. 2A–2C in an activated mode.

The tubing hanger H is then received in the wellhead housing W and landed on the casing hanger C so that the tubing hanger landing shoulder 56 rests on shoulder 26 of the casing hanger as illustrated in FIG. 1. The tubing hanger is locked down and the initial setting of the seals between the tubing hanger and the wellhead housing is accomplished while the pressure at port 234 is maintained. The hydraulic pressure at port 320 is vented and port 322 is pressurized. The resulting hydraulic pressure in chamber 296 causes outer actuating sleeve 280 to be forced longitudinally downward to the position illustrated in FIG. 7. The downward longitudinal force is transferred to the outer sleeve assembly 78 of the tubing hanger. Outer sleeve 78 is longitudinally displaced relative to the fixed middle sleeve 76 so that the wicker dogs 154 of segmented nut 152 ratchet over the threads 106 to provide the threaded engagement illustrated in FIGS. 2C, 7, and 9.

The downward force on the outer actuating sleeve is ultimately transferred to actuating sleeve 118 which radially forces locking/loading dogs 66 outwardly into locking engagement with locking groove 70 of the wellhead housing W. Shear pins 136 prevent premature actuation of the ring seals 132 and 134 by preventing relative longitudinal movement between lower section 112 and the middle section 114 of outer sleeve 78 until the application of a threshhold force sufficient to shear the pins. Port 322 is vented after being pressurized for several minutes. Tubing hanger lockdown may be verified by maintaining pressure on port 234 and performing a pull test on the tubing hanger. The locking of the tubing hanger to the wellhead housing W may also be verified by pressurizing port 324 and checking for a return of pressure at port 320.

The running tool R is released from the tubing hanger by venting port 234. Port 346 is pressurized to lift the release slide 238 and allow the lower actuating sleeve assembly 274 to be released from the latch dogs 334 which are forced inwardly toward the running tool body. Port 322 is then pressurized so that hydraulic pressure in chamber 296 forces the running tool body 200 upwardly. The engagement ends 318 of the latch dogs 308 are longitudinally displaced to a position below locking surface 310 thereby releasing the dogs from locking engagement in lock groove 148. The running tool R is released from the tubing hanger and free for retrieval to the surface.

A "final" lock down of the tubing hanger and energization of the sealing means between the tubing hanger and the wellhead housing, if needed, is accomplished by an HR tool such as is used to set the seal 34. It is to be noted that this "final" lock down procedure is performed only if a test shows that the tubing hanger/wellhead mating procedure as described above has not resulted in the achievement of a good seal. The HR tool is run down to the tubing hanger. The HR tool is rotated until lugs of the HR tool engage J slots 150 in the tubing hanger. The HR tool is then rotated to lock the tool to the tubing hanger. A lower pipe ram is then closed above the HR tool. Hydraulic pressure is applied by the HR tool to achieve a specified longitudinal load sufficient to force actuating sleeve 118 and middle section 114 together so that the sealing elements of seal rings 132 and 134 are radially displaced under the longitudinally acting compressive load. Shoulder portions of actuating sleeve 118 form a reaction base for seal rings 132 and 134. Seal ring 134 is forced to sealing engagement with inner reaction surface 124 and the exterior of tubing hanger body 52. Seal ring 132 is forced into sealing engagment with the outer reaction surface 126 and the inner surface of the wellhead housing W.

The HR tool is then rotated causing the upper section 116 of the outer sleeve to rotate to fully engage the wicker dogs 154 with the wicker threads 106 of the fixed sleeve 76. The HR tool is then rotated in the opposite direction to disengage the HR tool. The HR tool is then retrieved to the surface.

Upon completion of the above-described "final" lock down procedure, if performed, the running tool R is rerun. Before the running tool enters the blow-out preventor stack 18, all of the hydraulic control lines are connected. The balance and control ports are pressurized to open the annulus control check valve in the running tool to avoid a hydraulic lock condition. The running tool R is then landed in the tubing hanger and is connected to the tubing hanger as described above. It should be noted that the tubing hanger H and the running tool R are non-orienting; i.e., no angular orientation is required for connection or actuation. After connecting the tubing hanger H and the running tool R, port 234 is pressurized and all of the other ports are vented. Various tubing hanger seal tests are then carried out to determine the integrity of the sealing between the tubing hanger and the wellhead housing. If the seal tests are positive, the tubing hanger running tool R is released from the tubing hanger and retrieved as previously described.

If the seal tests are negative, i.e., show a seal leak, the seal/lock cartridge comprising the outer lock actuator sleeve 78 may be retrieved by the running tool R without requiring the retrieval of the entire tubing hanger. A verification is undertaken to verify that the running tool is locked to the tubing hanger. Port 234 is pressurized. Port 320 is then pressurized while maintaining the pressure on port 234. This latter distribution of hydraulic pressure retracts the outer sleeve 78 which is engaged to the longitudinally fixed middle sleeve 76. The running tool is then unlocked from the tubing hanger by latching dogs 334, port 320 is vented and port 322 is then pressurized to release the outer sleeve of the tubing hanger. Port 234 is vented to release the middle sleeve.

Port 236 is then pressurized. The pressure in lower hydraulic chamber 242 results in the downward expelling of slide 250. Slide 250 has a cam surface 251 which radially forces against lock actuator ring 254. Ring 254 lockingly engages an aligned locking groove 102 of the inner sleeve 74. A motion compensator is employed to exert an upward force approximately 10,000 lbs. greater than the downward load on the running string to release the retainer dogs 100. Port 236 is then vented to allow for the release of the seal/lock cartridge from the tubing hanger. The seal/lock cartridge is then retrieved. It should be appreciated the remaining core portion of the tubing hanger remains landed in position to the wellhead housing W.

In the event that the wicker dogs 154 have not engaged wicker thread 106, an upward load applied to the running tool will force inner sleeve 74 and outer sleeve 78 upwardly. The upward displacement of inner sleeve 74 results in releasing of the retainer dogs from fixed engagement with surface 98. After the inner sleeve retainer ring 92 engages locking groove 96, hydraulic pressure is vented at port 242 to allow for disengagement of the running tool from locking groove 102. When the inner sleeve 74 is in the upward position illustrated in FIG. 10, the retainer dogs are forced inwardly to release the seal/lock cartridge from the rest of the tubing hanger.

A replacement seal/lock cartridge as previously described may be re-installed by first connecting the replacement cartridge to the running tool R in the manner previously described for connecting the entire tubing hanger. The running tool R and the replacement cartridge are then re-run. Before the running tool R enters the blow-out preventor stack 18, all of the hydraulic control lines are connected. The balance and control lines to the running tool annulus bore check valve is pressurized to prevent hydraulic lock. Port 322 is pressurized. The connected running tool R and the replacement cartridge are landed on the tubing hanger. A shoulder on the running tool forces the inner sleeve 74 into the lock position wherein the retainer ring is snapped into locking groove 94 and the retainer dogs 100 are forced to the radially extended locked position. Port 322 is then vented and port 234 is pressurized to lock the running tool R to the tubing hanger as previously described. Port 322 is vented. Port 234 is pressurized and a pull test is undertaken to verify tubing hanger lockdown. As previously described, the tubing hanger running tool R is then retrieved, an HR tool is run, the seals are set by the HR tool, and the seals are tested.

The entire tubing hanger H may also be retrieved. The present invention provides for efficient tubing hanger retrieval by means of running tool R. Consequently, the tubing hanger running tool R and the tubing hanger H must be engaged and locked together for retrieval. Therefore, the technique for retrieving the tubing hanger is slightly different for the condition where there is full hydraulic control at the tubing hanger running tool as opposed to where there is no such hydraulic control. For a condition where there is full hydraulic control at the tubing hanger running tool, the balance and control lines, the production bore valve, the annulus bore control valve 190, and the annulus check valve in the tubing hanger running tool R are all pressurized. Port 244 is pressurized. While the pressure is maintained at port 234, port 230 is pressurized. The outer actuating sleeve 280 of the running tool R is thus retracted. The retraction results in the breaking of the wicker dog springs 162 to thereby unlock the tubing hanger by de-energizing the seal rings 132 and 134 and releasing the locking dogs 66. The tubing hanger is thus free for retrieval. When the tubing hanger clears the blow-out preventor stack 18, all of the hydraulic control lines are disconnected and the retrieval of the tubing hanger H is completed without hydraulic control.

When there is no hydraulic control at the tubing hanger running tool, the choke and kill lines to the blow-out preventor stack are opened. An upward load is slowly applied to break the wicker dog springs 162 and to release the dogs 154. The outer sleeve 78 of the tubing hanger will thus be released and the energizing load on the seals 132 and 134 will be relieved. A continued upward pull will release the loading/locking dogs 66 to unlock the tubing hanger from the wellhead housing. When the tubing hanger running tool clears the blow-out preventor stack, the choke and kill lines are closed. The tubing hanger is then retrieved.

An emergency quick disconnect sequence for the tubing hanger and the tubing hanger running tool is also provided. An emergency disconnect sequence is provided for each of three distinct situations. The first situation covers the period up until the point of actual entry of the tubing hanger into the blowout preventor stack 18. During this first period, the emergency disconnect involves closing the conventionally mounted shear rams (not illustrated), thus cutting the tubing string T. The tubing hanger, running tool, and running string are then retrieved. The second situation arises during the period between the entry of the tubing hanger into the blow-out preventor stack 18 and the actual landing of the tubing hanger on the casing hanger C. During this latter sequence, the tubing hanger and running tool will be raised above the shear rams. The tubing string T is cut and the tubing hanger and running tool are retrieved.

The final situation arises during the period after the tubing hanger has landed on the casing hanger C—regardless of the extent of the locking and sealing sequence. During this time period, the shear ram is closed on the running string leaving a link of tubing above the tubing hanger running tool. When contact is re-established with the tubing suspension system, a special tool is run to capture the tubing stub and retrieve the tubing hanger and running tool. The retrieval tool applies a sufficient upward force to free the wicker dogs.

While preferred embodiments of a tubing hanger suspension system and a running tool for use therewith have has been set forth for purposes of illustration, the foregoing description should not be deemed a limitation of the invention herein. Accordingly, various modifications, adaptations, and alternatives may occur to one skilled in the art without departing from the spirit and scope of the present invention.

What is claimed is:

1. A tubing hanger comprising:

a hanger body including an inner body portion having a suspension means to support a longitudinally extending tubing string and a lower body portion having a transversely disposed landing shoulder, said body mounting a radially movable wellhead locking means;

fixed middle sleeve means mounted to said hanger body in concentric relation therewith, said middle sleeve means including a radially positionable retainer means;

inner sleeve means concentric with said middle sleeve means and longitudinally movable relative thereto to control the position of said fixed middle sleeve means retainer means;

a retrievable outer sleeve assembly releasably captured by said middle sleeve means retainer means and concentric with said middle and inner sleeve means, said outer sleeve assembly comprising actuator means for causing radial movement of said wellhead locking means, said outer sleeve assembly further comprising a radially engageable sealing means and a sleeve locking means to secure said outer sleeve assembly to said middle sleeve at a selective relative longitudinal position, said wellhead locking means, said sealing means, and said sleeve locking means being actuable by a longitudinally acting load applied to said outer sleeve assembly.

2. The tubing hanger of claim 1 wherein said middle sleeve and said outer sleeve assembly include interior circumferentially extending locking grooves.

3. The tubing hanger of claim 1 wherein the retainer means comprises a plurality of angularly spaced dogs.

4. The tubing hanger of claim 1 wherein the inner sleeve mounts a retainer ring and said middle sleeve includes a retainer groove, said retainer ring being receivable in said groove so that the retainer means is forced to an extended radial position.

5. The tubing hanger of claim 1 wherein said sleeve locking means comprises a wicker thread extending from said middle sleeve and said outer sleeve assembly includes a spring loaded segmented nut means to ratchet over and to engage said wicker thread.

6. The tubing hanger of claim 5 wherein said segmented nut means includes a plurality of angularly spaced wicker dogs each secured to a sleeve portion of the outer sleeve assembly by means of a spring.

7. The tubing hanger of claim 6 wherein the outer assembly further includes a ramp structure, said springs being adapted to fail upon application of a preestablished upward longitudinal load, said ramp structure adapted to force the wicker dogs from the wicker thread to release the sleeve locking means.

8. The tubing hanger of claim 1 wherein the outer sleeve assembly comprises a lower sleeve section having a tapered contact surface and an intermediate sleeve section mounting said sealing means.

9. The tubing hanger of claim 8 wherein the wellhead locking means includes a plurality of angularly spaced lock dogs and said actuator means includes said tapered contact surface.

10. The tubing hanger of claim 8 wherein the sealing means comprises two concentric seal rings, each said ring being longitudinally compressible for bidirectional radial sealing.

11. The tubing hanger of claim 10 wherein the lower sleeve section includes an upper annular tongue projecting from a shoulder, said intermediate section forming a groove between said seal rings, said groove receiving said tongue, one side of each of said seal. rings being sealable against said tongue and said shoulder forming a reaction surface for said seal rings.

12. The tubing hanger of claim 11 wherein the outer sleeve assembly includes shear pin means to prevent premature actuation of said sealing means.

13. The tubing hanger of claim 8 wherein the outer sleeve assembly further comprises an upper sleeve section, a bearing means connecting said upper and intermediate sleeve sections so that longitudinal loads applied to said upper sleeve are transferred to said intermediate sleeve and the upper sleeve is rotatable relative to said intermediate sleeve.

14. The tubing hanger of claim 1 wherein the hanger body includes a production bore, a concentric annulus bore, and an annulus access bore, an annulus control valve means being mounted to control communication between the access and the annulus bores.

15. The tubing hanger of claim 14 wherein the valve means is a spring closed ball valve which is opened by hydraulic means.

16. A running tool for a tubing hanger comprising:

an inner body having a central longitudinally extending passage therethrough;

an outer actuating sleeve concentric with said inner body and longitudinally moveable relative thereto, said actuating sleeve carrying a first latch means for generally radial engagement and having a catch means;

second latch means engageable with said catch means to secure the actuating sleeve at a longitudinal position relative to said inner body;

release slide means to actuate said second latch means;

hydraulically controlled movement means for effecting relative longitudinal movement between said actuating sleeve and inner body;

first locking means mounted to said inner body and radially extendable for radial locking engagement; and second locking means mounted to said inner body and radially extendable for radial locking engagement.

17. The running tool of claim 16 wherein said first latch means comprises a plurality of downwardly extending angularly spaced elongated latch dogs having a radially positionable latch end.

18. The running tool of claim 16 wherein the actuating sleeve has an upper outer sleeve portion forming a recess with said body and said catch means comprises an upper lip forming an upper interior groove portion of said recess.

19. The running tool of claim 18 wherein the second latch means comprises a plurality of downwardly extending angularly spaced elongated latch dogs having a radially positionable latch end engageable in said groove portion.

20. The running tool of claim 16 wherein the release slide assembly comprises a hydraulically controlled longitudinally positionable slide which is engageable with said second latch means for controlling the radial position thereof.

21. The running tool of claim 16 wherein the first locking means comprises a hydraulically controlled slide member which is engageable with a lock ring to control the radial extension thereof.

22. The running tool of claim 16 wherein the second locking means comprises a hydraulically controlled slide member which is engageable with a lock ring to control the radial extension thereof.

23. The running tool of claim 16 wherein the inner body has a first cylindrical surface portion which downwardly tapers to a second cylindrical surface portion having a reduced diameter, the first latching dog being inwardly radially retained in a latching mode engagement against the first cylindrical surface.

24. The running tool of claim 23 wherein the first latching means is released from the latching mode by longitudinally moving said first latching means out of engagement with the first cylindrical surface.

25. The running tool of claim 16 further comprising a riser connection means to connect the running tool to a completion riser.

26. The running tool of claim 16 further comprising a downwardly protruding production bore seal sub and a concentric annulus access seal sub.

27. The running tool of claim 16 wherein a circumferentially extending shoulder radially projects from said inner body, said shoulder sealingly engaging the interior of said actuating sleeve to form in cooperation with exterior portions of said inner body an upper hydraulic chamber and a lower hydraulic chamber, said movement means including means for controlling the hydraulic pressure in said chambers.

* * * * *